US009062497B2

(12) United States Patent
Wassermann et al.

(10) Patent No.: US 9,062,497 B2
(45) Date of Patent: Jun. 23, 2015

(54) PHASE ESTIMATION FROM ROTATING SENSORS TO GET A TOOLFACE

(75) Inventors: Ingolf Wassermann, Hannover (DE); Fang Zhang, Shanghai (CN); Thomas Kelch, Niedersachsen (DE); Levin L. Bong, Hannover (DE); Sven Krueger, Niedersachsen (DE)

(73) Assignee: BAKER HUGHES INCORPORATED, Houston, TX (US)

( * ) Notice: Subject to any disclaimer, the term of this patent is extended or adjusted under 35 U.S.C. 154(b) by 687 days.

(21) Appl. No.: 12/607,722

(22) Filed: Oct. 28, 2009

(65) Prior Publication Data

US 2010/0187008 A1 Jul. 29, 2010

Related U.S. Application Data

(63) Continuation-in-part of application No. 12/260,282, filed on Oct. 29, 2008, now abandoned.

(51) Int. Cl.
*E21B 47/02* (2006.01)
*E21B 7/06* (2006.01)
*E21B 47/024* (2006.01)

(52) U.S. Cl.
CPC ..... *E21B 7/068* (2013.01); *E21B 47/024* (2013.01)

(58) Field of Classification Search
CPC .. E21B 47/024; E21B 47/02216; E21B 7/068
USPC ..... 166/255.1, 255.2, 255.3; 175/45; 33/304, 313; 275/45
See application file for complete search history.

(56) References Cited

U.S. PATENT DOCUMENTS

| | | | | |
|---|---|---|---|---|
| 4,021,774 | A * | 5/1977 | Asmundsson et al. | 340/853.8 |
| 6,131,694 | A * | 10/2000 | Robbins et al. | 181/105 |
| 6,196,336 | B1 | 3/2001 | Fincher et al. | |
| 6,581,699 | B1 * | 6/2003 | Chen et al. | 175/61 |
| 7,036,611 | B2 | 5/2006 | Radford et al. | |
| 7,299,884 | B2 | 11/2007 | Mathiszik | |
| 7,413,032 | B2 | 8/2008 | Krueger | |
| 7,548,817 | B2 | 6/2009 | Hassan et al. | |
| 2008/0230273 | A1 * | 9/2008 | Brooks | 175/45 |
| 2008/0294344 | A1 * | 11/2008 | Sugiura | 702/6 |
| 2009/0050370 | A1 | 2/2009 | Peters | |
| 2009/0090555 | A1 * | 4/2009 | Boone et al. | 175/45 |
| 2010/0139976 | A1 * | 6/2010 | Rodney | 175/45 |

FOREIGN PATENT DOCUMENTS

WO WO 2006047523 A1 * 5/2006 ..... E21B 47/024

OTHER PUBLICATIONS

Floyd M. Gardner, Phaselock Techniques, Wiley, New York, 2005, pp. 65-95.
J.G. Proakis, "The Phase-locked-loop," Digital Communication, 2001, pp. 341-359.

* cited by examiner

*Primary Examiner* — James G Sayre
(74) *Attorney, Agent, or Firm* — Mossman Kumar & Tyler PC

(57) ABSTRACT

Measurements made by a rotating sensor on a bottomhole assembly are used to determine the toolface angle of the BHA. The method includes using a phase locked loop (PLL) to determine a phase difference between the sensor output and a reference signal.

20 Claims, 9 Drawing Sheets

PHASE ESTIMATION FROM ROTATING SENSORS TO GET A TOOLFACE

CROSS-REFERENCES TO RELATED APPLICATIONS

This application is a continuation-in-part of U.S. patent application Ser. No. 12/260,282 filed on Oct. 29, 2008, the contents of which are fully incorporated herein.

FIELD OF THE DISCLOSURE

This disclosure relates generally to bottom hole assemblies for drilling oilfield wellbores and more particularly to the use of accelerometers to determine wellbore and drilling tool direction during the drilling of the wellbores.

BACKGROUND OF THE DISCLOSURE

To obtain hydrocarbons such as oil and gas, wellbores (also referred to as the boreholes) are drilled by rotating a drill bit attached at the end of a drilling assembly generally referred to as the "bottom hole assembly" (BHA) or the "drilling assembly." A large portion of the current drilling activity involves drilling highly deviated and substantially horizontal wellbores to increase the hydrocarbon production and/or to withdraw additional hydrocarbons from the earth's formations. The wellbore path of such wells is carefully planned prior to drilling such wellbores utilizing seismic maps of the earth's subsurface and well data from previously drilled wellbores in the associated oil fields. Due to the very high cost of drilling such wellbores and the need to precisely place such wellbores in the reservoirs, it is essential to frequently determine the position and direction of the drilling assembly and thus the drill bit during drilling of the wellbores. Such information is utilized, among other things, to monitor and adjust the drilling direction of the wellbores. It should be noted that the terms "wellbore" and "borehole" are used interchangeably in the present document.

In the commonly used drilling assemblies, the directional package commonly includes a set of accelerometers and a set of magnetometers, which respectively measure the earth's gravity and magnetic fields. The drilling assembly is held stationary during the taking of the measurements from the accelerometers and the magnetometers. The toolface and the inclination angle are determined from the accelerometer measurements. The azimuth is then determined from the magnetometer measurements in conjunction with the tool face and inclination angle. As used herein, the term "toolface" means the orientation angle of the bent housing or sub in the borehole with respect to a reference such as high side of the borehole which indicates the direction in which the borehole will be curving. The inclination angle is the angle between the borehole axis and the vertical (direction of the gravity field). The azimuth is the angle between the horizontal projection of the borehole axis and a reference direction such as magnetic north or absolute north.

The earth's magnetic field varies from day to day, which causes corresponding changes in the magnetic azimuth. The varying magnetic azimuth compromises the accuracy of the position measurements when magnetometers are used. Additionally, it is not feasible to measure the earth's magnetic field in the presence of ferrous or ferromagnetic materials, such as casing and drill pipe. The presence of ferrous or ferromagnetic materials is particularly problematic when kicking-off directly below a casing shoe, or over a whipstock. Gyroscopes measure the rate of the earth's rotation, which does not change with time nor are the gyroscopes adversely affected by the presence of ferrous materials. Thus, in the presence of ferrous materials the gyroscopic measurements can provide more accurate azimuth measurements than the magnetometer measurements. However, gyroscopes have to contend with the large differences in magnitude between the earth rotational rate (approximately 15°/hr) and toolface changes during typical drilling (typically 45°/s). For this reason, it is desirable to determine toolface angles using only accelerometers.

SUMMARY OF THE DISCLOSURE

One embodiment of the disclosure is a method of conducting drilling operations. The method includes conveying a bottomhole assembly (BHA) into a borehole; operatively coupling at least one sensor to the BHA to provide an orientation signal during rotation of the BHA and estimating an orientation of the at least one sensor using a phase difference between the signal and a reference signal.

Another embodiment of the disclosure is an apparatus for conducting drilling operations. The apparatus includes a bottomhole assembly (BHA) configured to be conveyed into a borehole; at least one sensor operatively coupled to the BHA and configured to provide an orientation signal during rotation of the BHA; and at least one processor configured to estimate an orientation of the at least one sensor using a phase difference between the signal and a reference signal.

BRIEF DESCRIPTION OF THE DRAWINGS

For detailed understanding of the present disclosure, references should be made to the following detailed description of specific embodiments, taken in conjunction with the accompanying drawings, in which like elements have been given like numerals, wherein.

DETAILED DESCRIPTION OF THE DISCLOSURE

Figure 1:
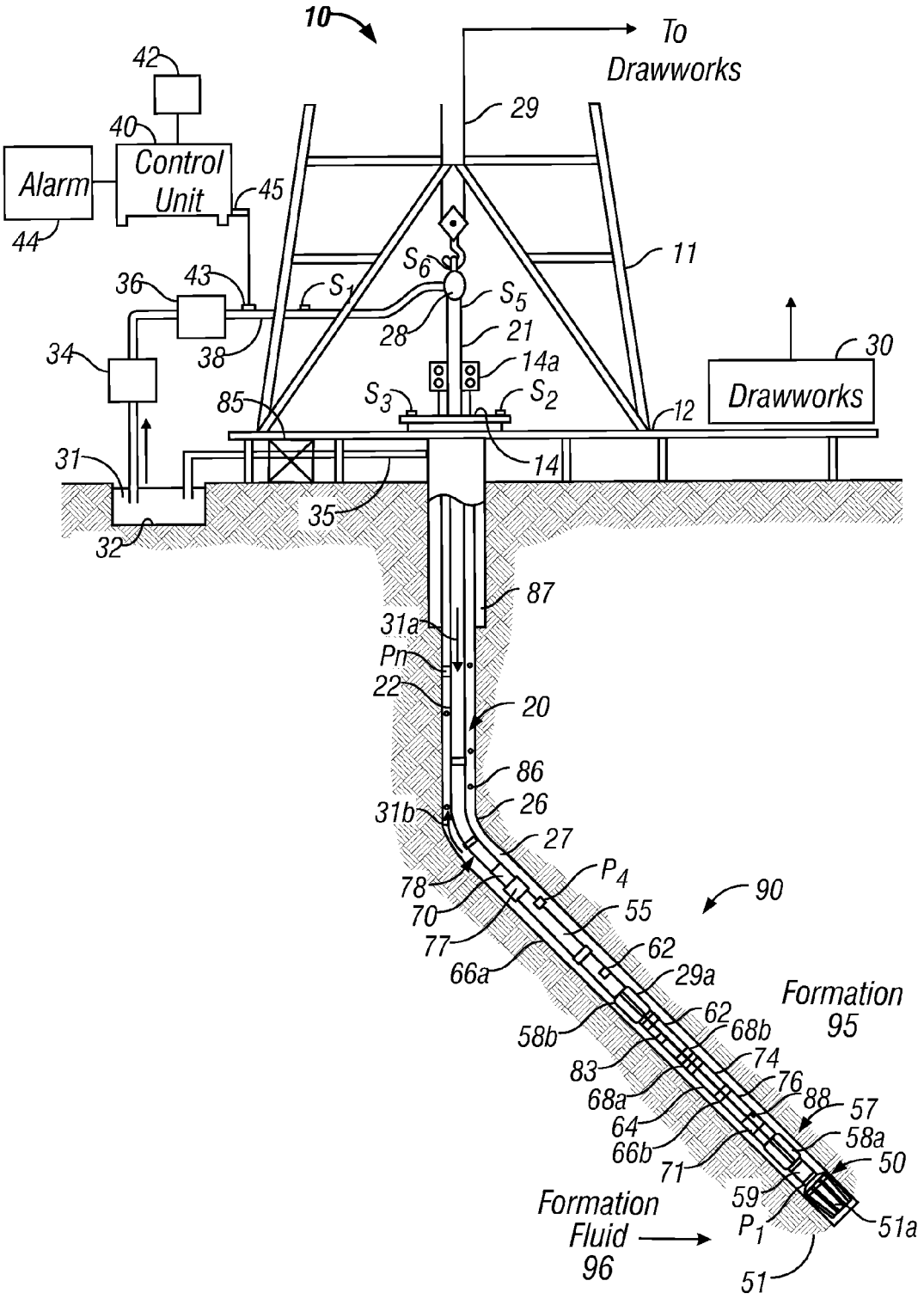
FIG. 1 (Prior Art)
FIG. 1 shows a schematic diagram of a drilling system that employs the apparatus of the current disclosure in a measurement-while-drilling embodiment.

FIG. 1 (prior art) shows a schematic diagram of a drilling system 10 having a bottom hole assembly (BHA) or drilling assembly 90 that includes gyroscope(s) according to the present disclosure. The BHA 90 is conveyed in a borehole 26. The drilling system 10 includes a conventional derrick 11 erected on a floor 12 which supports a rotary table 14 that is rotated by a prime mover such as an electric motor (not shown) at a desired rotational speed. The drill string 20 includes a tubing (drill pipe or coiled-tubing) 22 extending downward from the surface into the borehole 26. A drill bit 50, attached to the drill string 20 end, disintegrates the geological formations when it is rotated to drill the borehole 26. The drill string 20 is coupled to a drawworks 30 via a kelly joint 21, swivel 28 and line 29 through a pulley (not shown). Drawworks 30 is operated to control the weight on bit ("WOB"), which is an important parameter that affects the rate of penetration ("ROP"). A tubing injector 14*a* and a reel (not shown) are used as instead of the rotary table 14 to inject the BHA into the wellbore when a coiled-tubing is used as the conveying member 22. The operations of the drawworks 30 and the tubing injector 14*a* are known in the art and are thus not described in detail herein.

During drilling, a suitable drilling fluid 31 from a mud pit (source) 32 is circulated under pressure through the drill string 20 by a mud pump 34. The drilling fluid passes from the mud pump 34 into the drill string 20 via a desurger 36 and the fluid line 38. The drilling fluid 31 discharges at the borehole bottom 51 through openings in the drill bit 50. The drilling fluid 31 circulates uphole through the annular space 27 between the drill string 20 and the borehole 26 and returns to the mud pit 32 via a return line 35 and drill cutting screen 85 that removes the drill cuttings 86 from the returning drilling fluid 31*b*. A sensor $S_1$ in line 38 provides information about the fluid flow rate. A surface torque sensor $S_2$ and a sensor $S_3$ associated with the drill string 20 respectively provide information about the torque and the rotational speed of the drill string 20. Tubing injection speed is determined from the sensor $S_5$, while the sensor $S_6$ provides the hook load of the drill string 20.

In some applications the drill bit 50 is rotated by only rotating the drill pipe 22. However, in many other applications, a downhole motor 55 (mud motor) is disposed in the drilling assembly 90 to rotate the drill bit 50 and the drill pipe 22 is rotated usually to supplement the rotational power, if required, and to effect changes in the drilling direction. In either case, the ROP for a given BHA largely depends on the WOB or the thrust force on the drill bit 50 and its rotational speed.

The mud motor 55 is coupled to the drill bit 50 via a drive disposed in a bearing assembly 57. The mud motor 55 rotates the drill bit 50 when the drilling fluid 31 passes through the mud motor 55 under pressure. The bearing assembly 57 supports the radial and axial forces of the drill bit 50, the downthrust of the mud motor 55 and the reactive upward loading from the applied weight on bit. A lower stabilizer 58*a* coupled to the bearing assembly 57 acts as a centralizer for the lowermost portion of the drill string 20.

A surface control unit or processor 40 receives signals from the downhole sensors and devices via a sensor 43 placed in the fluid line 38 and signals from sensors $S_1$-$S_6$ and other sensors used in the system 10 and processes such signals according to programmed instructions provided to the surface control unit 40. The surface control unit 40 displays desired drilling parameters and other information on a display/monitor 42 that is utilized by an operator to control the drilling operations. The surface control unit 40 contains a computer, memory for storing data, recorder for recording data and other peripherals. The surface control unit 40 also includes a simulation model and processes data according to programmed instructions. The control unit 40 may be adapted to activate alarms 44 when certain unsafe or undesirable operating conditions occur.

The BHA may also contain formation evaluation sensors or devices for determining resistivity, density and porosity of the formations surrounding the BHA. A gamma ray device for measuring the natural gamma ray intensity and other nuclear and non-nuclear devices used as measurement-while-drilling devices are suitably included in the BHA 90. As an example, FIG. 1 shows a resistivity measuring device 64. It provides signals from which resistivity of the formation near or in front of the drill bit 50 is determined. The resistivity device 64 has transmitting antennae 66*a* and 66*b* spaced from the receiving antennae 68*a* and 68*b*. In operation, the transmitted electromagnetic waves are perturbed as they propagate through the formation surrounding the resistivity device 64. The receiving antennae 68*a* and 68*b* detect the perturbed waves. Formation resistivity is derived from the phase and amplitude of the detected signals. The detected signals are processed by a downhole computer 70 to determine the resistivity and dielectric values.

An inclinometer 74 and a gamma ray device 76 are suitably placed along the resistivity measuring device 64 for respectively determining the inclination of the portion of the drill string near the drill bit 50 and the formation gamma ray intensity. Any suitable inclinometer and gamma ray device, however, may be utilized for the purposes of this disclosure. In addition, position sensors, such as accelerometers, magnetometers or a gyroscopic device may be disposed in the BHA to determine the drill string azimuth, true coordinates and direction in the wellbore 26. Such devices are known in the art and are not described in detail herein.

In the above-described configuration, the mud motor 55 transfers power to the drill bit 50 via one or more hollow shafts that run through the resistivity measuring device 64. The hollow shaft enables the drilling fluid to pass from the mud motor 55 to the drill bit 50. In an alternate embodiment of the drill string 20, the mud motor 55 may be coupled below resistivity measuring device 64 or at any other suitable place. The above described resistivity device, gamma ray device and the inclinometer may be placed in a common housing that may be coupled to the motor. The devices for measuring formation porosity, permeability and density (collectively designated by numeral 78) may be placed above the mud motor 55. Such devices are known in the art and are thus not described in any detail.

As noted earlier, a large portion of the current drilling systems, especially for drilling highly deviated and horizontal wellbores, utilize coiled-tubing for conveying the drilling assembly downhole. In such application a thruster 71 is deployed in the drill string 90 to provide the required force on the drill bit. For the purpose of this disclosure, the term weight on bit is used to denote the force on the bit applied to the drill bit during the drilling operation, whether applied by adjusting the weight of the drill string or by thrusters. Also, when coiled-tubing is utilized the tubing is not rotated by a rotary table, instead it is injected into the wellbore by a suitable injector 14*a* while the downhole motor 55 rotates the drill bit 50.

A number of sensors are also placed in the various individual devices in the drilling assembly. For example, a variety of sensors are placed in the mud motor power section, bearing assembly, drill shaft, tubing and drill bit to determine the condition of such elements during drilling and to determine the borehole parameters. A manner of deploying certain sensors in drill string 90 will now be described. The actual BHA utilized for a particular application may contain some or all of the above described sensors. For the purpose of this disclosure any such BHA could contain one or more gyroscopes and a set of accelerometers (collectively represented herein by numeral 88) at a suitable location in the BHA 90. A novel feature of the disclosure is that the downhole processor is configured to determine the orientation of an accelerometer, magnetometer and/or gyro using the concepts discussed below.

Figure 2A:
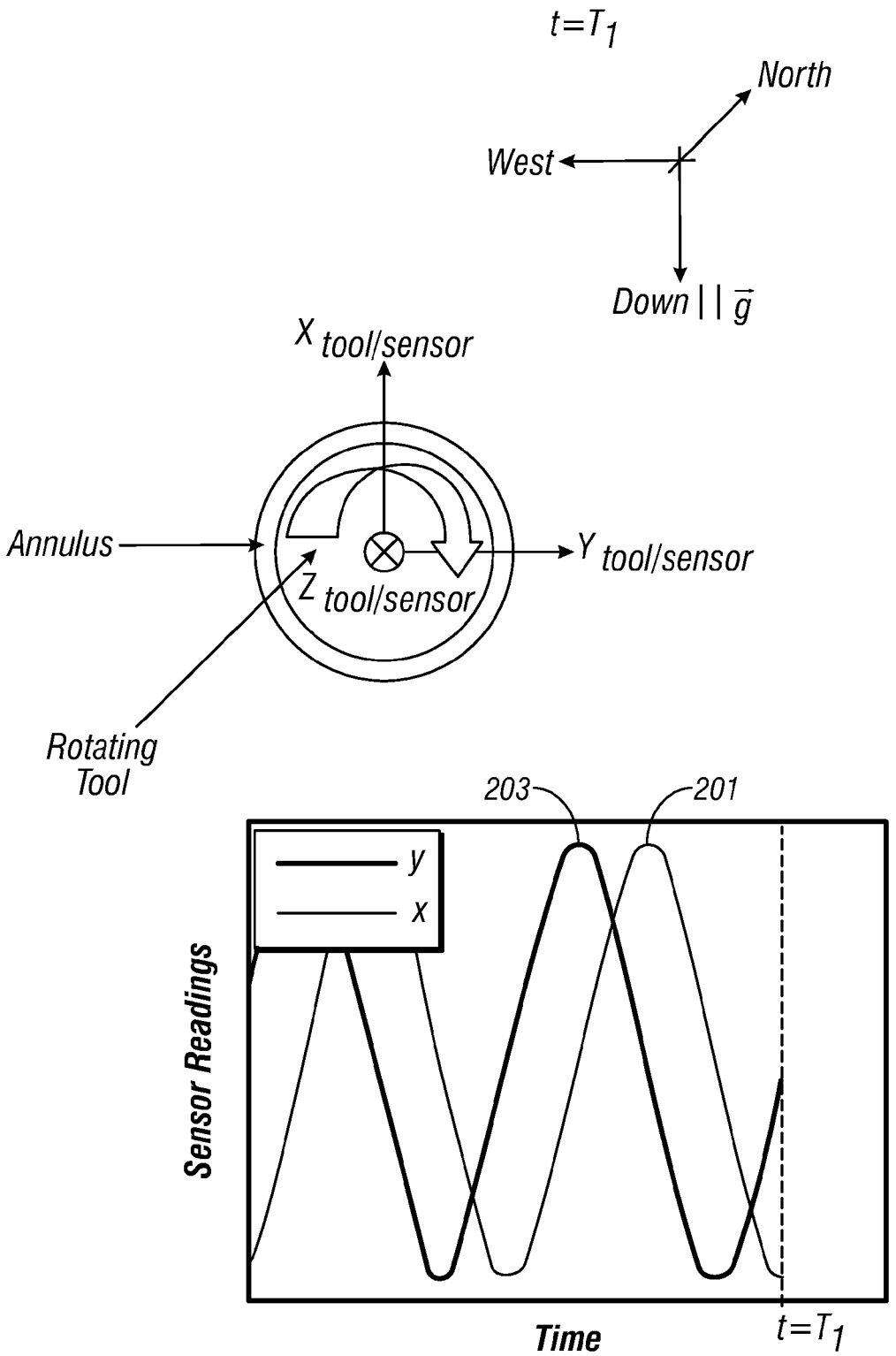
FIGS. 2A and 2B show examples of accelerometer readings with corresponding toolface positions.
Figure 2B:
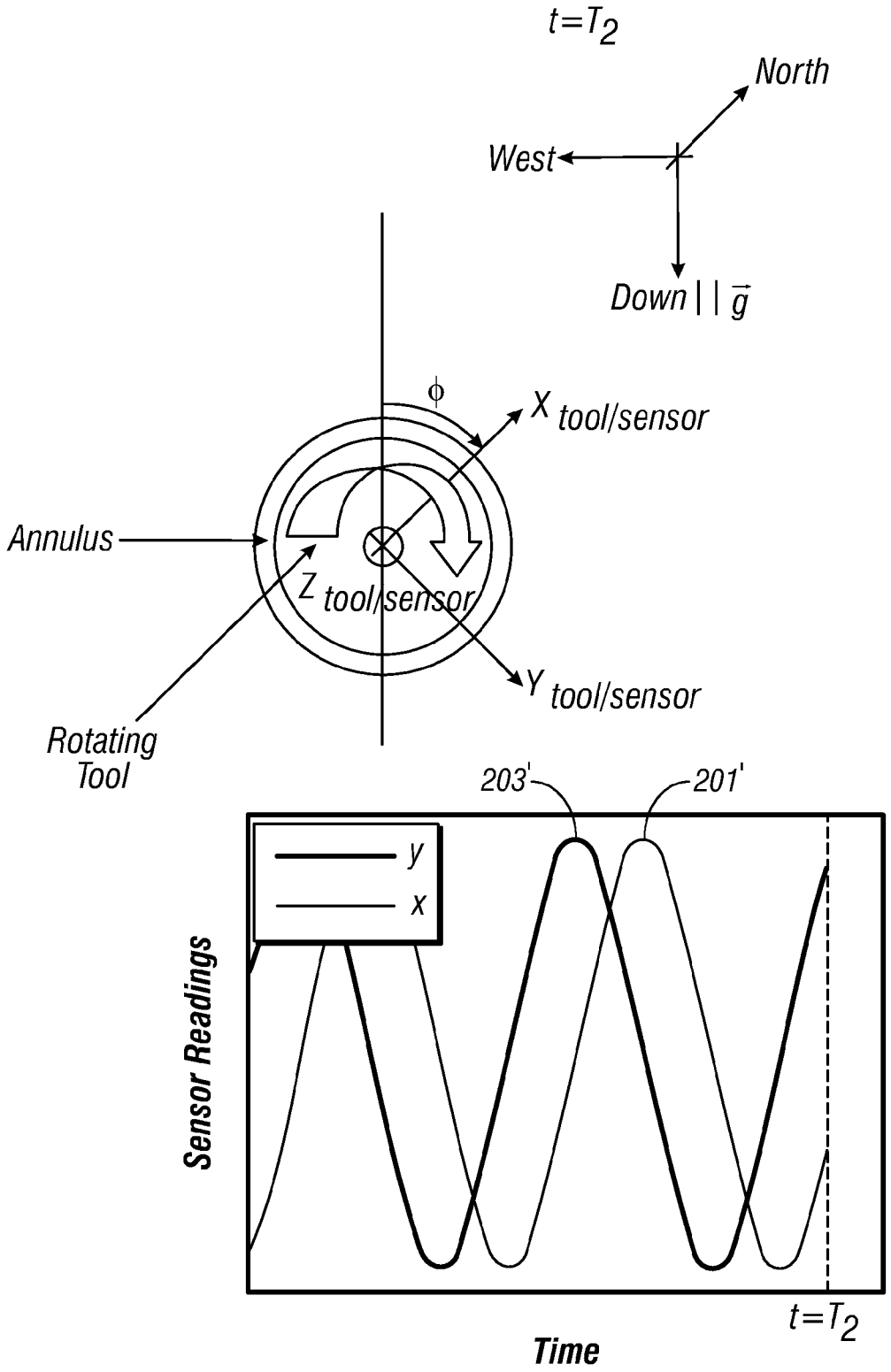

The problem addressed here is the estimation of the current rotary displacement $\phi$ of a reference point (such as an accelerometer) relative to the tool high side. This means we want to link the rotating coordinate system of the tool/sensor and a fixed global coordinate system. In FIG. 2A, the sensor readings x-201 and y-203 component accelerometers at time instants $t=T_1$ together with drawings of the rotating tool with its local coordinate system in the corresponding position are shown. In FIG. 2B, the sensor readings x-201' and y-203' component accelerometers at time instants $t=T_2$ together with drawings of the rotating tool with its local coordinate system in the corresponding position are shown. The sensor readings have a sinusoidal character. The instantaneous phase $\phi$ is a direct measure for the rotary displacement of the sensor axes relative to tool high side. Therefore the problem of toolface estimation reduces to one of phase estimation.

Figure 3:
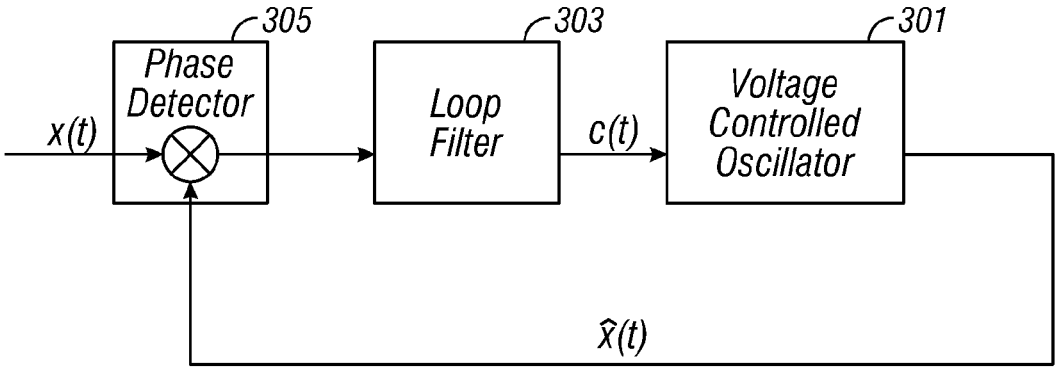
FIG. 3 shows a basic phase-locked loop (PLL) for phase estimation.

Various phase estimators exist in the literature. They are generally known as phase-locked loops (PLL). As depicted in FIG. 3, a PLL comprises a Voltage Controlled Oscillator (VCO) 301, which is a sinusoidal signal generator, a phase detector 305 and a structure of loop filters 303 to control the oscillator. Usually the loop filters are low pass filters. A phase detector 305 can be implemented, for example, as multiplier. The basic PLL is depicted in FIG. 3 for processing the x-component accelerometer signal. Various other designs are possible as well.

PLLs can be implemented as analog and as digital systems. The PLLs disclosed here can easily be adapted to a digital system. The generic structure of a PLL does not change with the type of implementation. The loop filters and phase detectors are still present in a digital implementation, the VCO is replaced by a numerically controlled oscillator (NCO). In this disclosure, for simplicity, continuous notation is used, though it is to be understood that digital implementation is also feasible. Phase detectors are depicted as multipliers.

The VCO phase is controlled by the loop filter output signal c(t)

$$\phi_{VCO}(t) = 2\pi f_{VCO} t + K \int_{-\infty}^{t} c(\tau) d\tau, \tag{1}$$

where $\phi_{VCO}(t)$ is an estimate of the input signal phase $\phi(t)$. $f_{VCO}$ is the oscillating frequency of the VCO and corresponds with the instantaneous frequency of the loop input signal x(t). Finally K is the loop gain.

Figure 4:
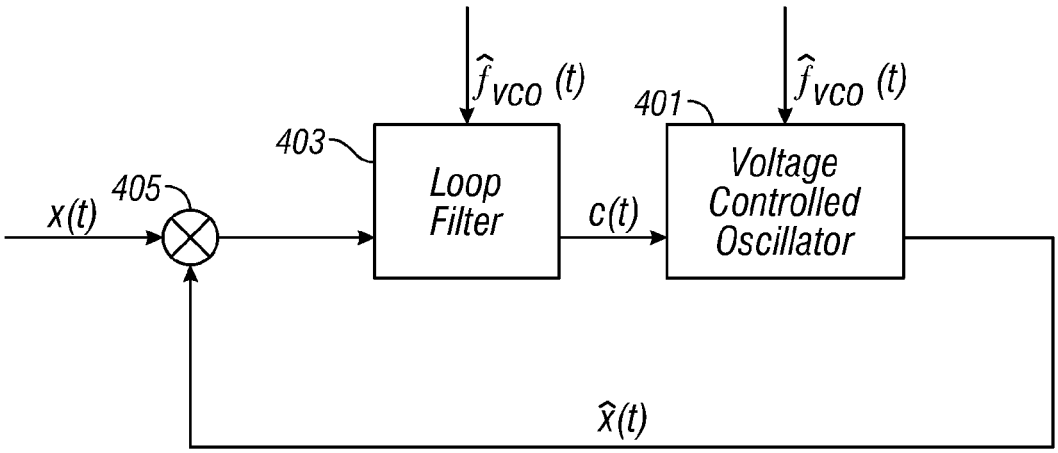
FIG. 4 illustrates a PLL with time-varying input frequency.

Those versed in the art would recognize that the rotational speed of a drillbit is very rarely uniform. Thus, the signal frequency $f_{sig}$ (t) is not constant over time but reflects the downhole rotational speed. Therefore a frequency estimator is introduced. The frequency estimator evaluates the PLL input signal x(t) or other signals, for example, from other sensors. FIG. 4 shows an implementation in which the instantaneous frequency estimate $\hat{f}_{sig}(t)$ is fed as $\hat{f}_{VCO}(t)$ to the VCO. This is denoted by 401. Optionally, $\hat{f}_{VCO}(t)$ can also control the loop filter characteristics 403. The phase detector is denoted by 403.

The estimate $\hat{f}_{sig}(t)$ of the signal frequency $f_{sig}(t)$ is used as external signal to adjust the loop filter, the preprocessing (i.e. bandpass filter for noise reduction) and to control the oscillator or the frequency shifter, if applicable. It can be obtained from various signals, using a wide range of algorithms. Typically the frequency estimation is done on signals that are not vulnerable to noise, e.g. magnetometer readings or gyro measurements. Assuming identical sensor gains for the measurement in the orthogonal x and y directions the instantaneous frequency estimate follows:

$$\hat{f}_{sig}(t) = \frac{\partial \phi(t)}{\partial t} \text{ or } \hat{f}_{sig}(k) = \frac{\Delta\phi}{\Delta t} = (\phi(k) - \phi(k-1)) f_s$$

for continuous and time-discrete implementations, respectively.

$$\phi(t) = \arctan\left(\frac{y(t)}{x(t)}\right), \phi(k) = \arctan\left(\frac{y(k)}{x(k)}\right)$$

Figure 5:
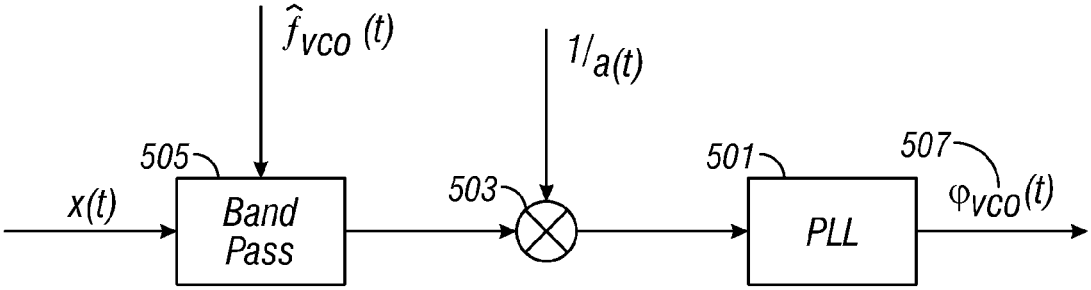
FIG. 5 illustrates preprocessing with signal normalization.

Those versed in the art and having benefit of the present disclosure would recognize that the amplitude of x(t) may change over time and have a DC offset. This would affect the control signal c(t). Additionally, the signals may be distorted by noise. Accordingly, the PLL input signal may be preprocessed with a band-pass filter to reduce noise and to make the signal zero mean. This is illustrated in FIG. 5. The band-pass filter 505 characteristics are controlled by $\hat{f}_{VCO}(t)$. The signal amplitude a(t) is normalized 503 to a fixed amplitude using an automated gain control (AGC). The instantaneous signal amplitude a(t) can be estimated from the band-pass output itself as well as from other sensor signals. The output of the preprocessing is input to a PLL 501.

The phase estimate $\phi_{VCO}(t)$ is vulnerable to frequency estimation errors. Hence the loop feedback signal $\hat{x}(t)$ is used to further adjust the VCO oscillation frequency.

As noted in FIGS. 2A-2B, typically there are multiple sensors (x- and y-) rotating in the field. While in FIGS. 2A-2B both sensors x and y are accelerometers, it is possible to have other sensors responsive to factors other than gravity. The other sensors could include magnetometers and gyros. All of them can be used to estimate the phase.

Figure 6:
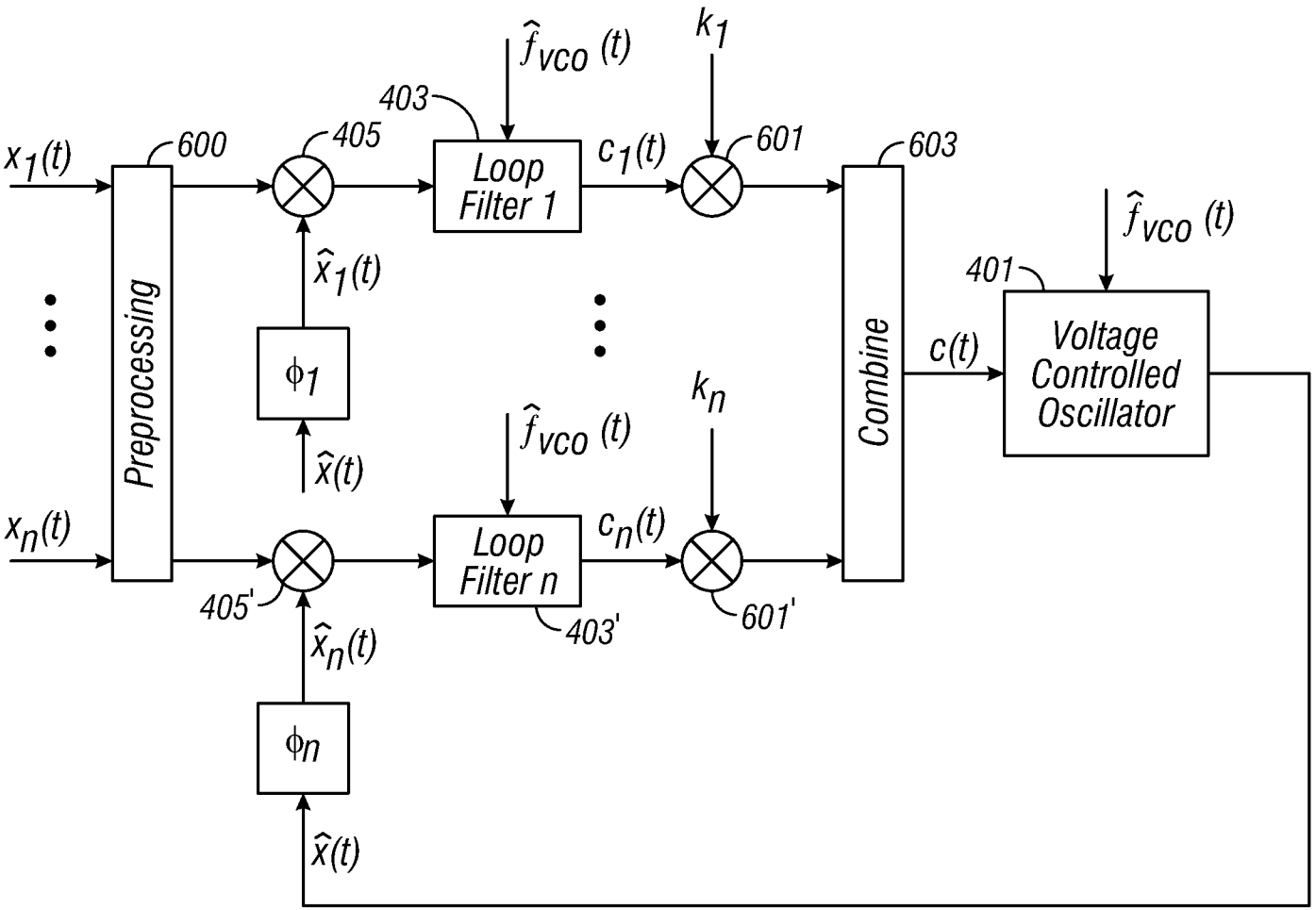
FIG. 6 shows a multi-sensor system for phase estimation.

A possible implementation of a basic PLL for a multi-sensor system is given in FIG. 6. Shown therein are two input signals $x_1(t)$ and $x_n(t)$ with associated phases $\phi_1$ and $\phi_n$. The corresponding phase detectors are denoted by 405 and 405' while the associated loop filters are indicated by 403 and 403'. The output signals $c_i(t)$ of the loop filters are combined 603 to provide an input signal to the VCO 401. The combination may be done using a weighted 601, 601' summation, a weighted sum of squares, or a weighted complex summation, the respective weights being denoted by $k_i$ Thus, with n sensor signals $x_i(t)$, i=1, . . . n, we get n control signals $c_i(t)$ which are combined to the signal c(t) controlling the VCO. The phase of the VCO output signal $\hat{x}(t)$ has to be changed according to the phase offsets $\phi_i$ of the sensors relative to a reference phase. The reference may be the phase of one of the sensors or a dedicated position in the rotating tool coordinate system. Before feeding the sensor signals $x_i(t)$ in the multi-signal PLL the signals may be preprocessed by 600 representing the preprocessing done by 503 and 505 in FIG. 5. The preprocessing can be done individually or signals may be processed together.

Figure 7:
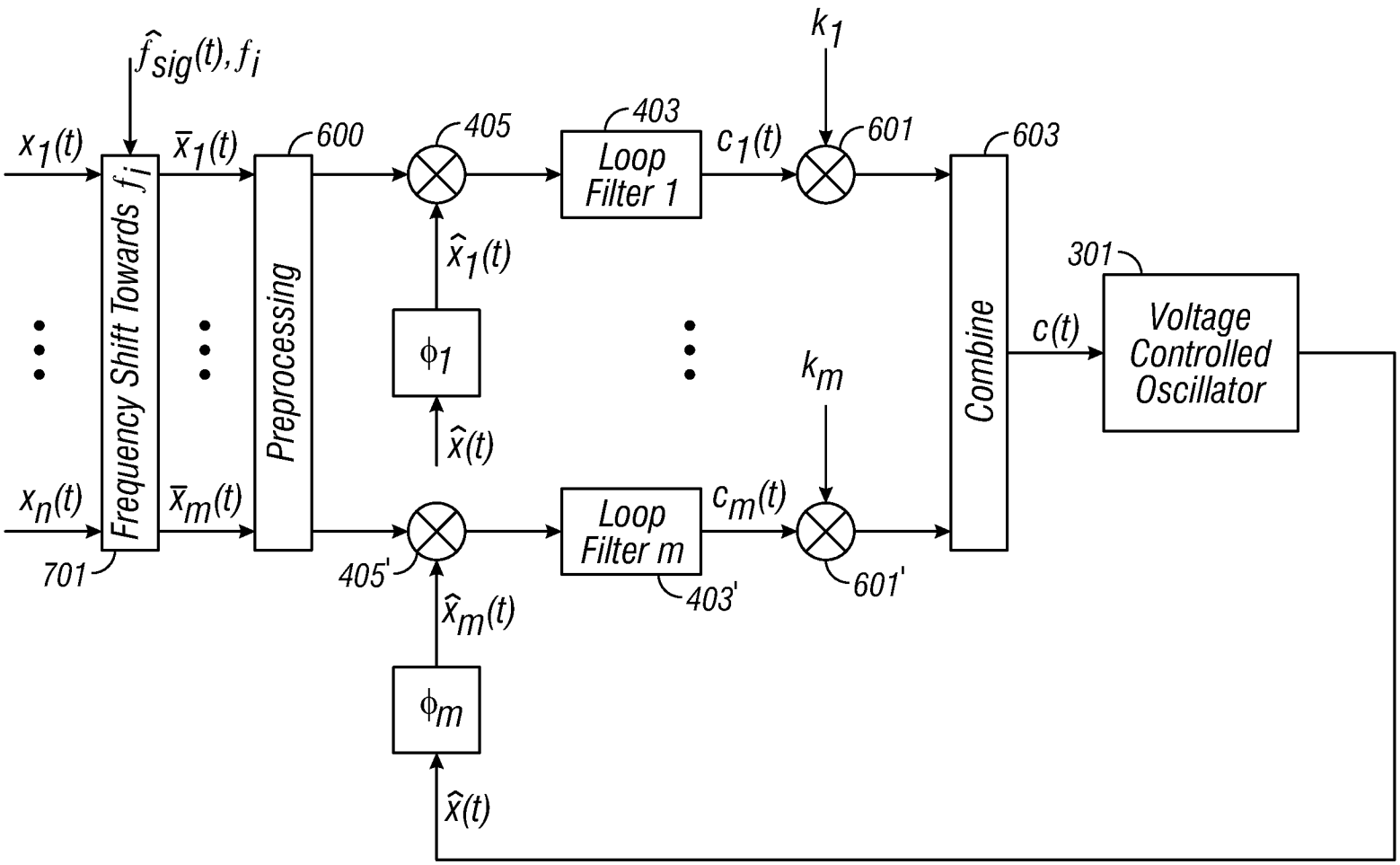
FIG. 7 shows a multi-sensor PLL with frequency shifting.

Instead of adapting the loop filters and the VCO to the instantaneous signal frequency $f_{sig}(t)$ or its estimate $\hat{f}_{sig}(t)$, in one embodiment the input signals are shifted towards a fixed intermediate frequency $f_i$. This is exemplified for a multi-sensor system in FIG. 7 by 701. In this embodiment, the frequency of the VCO is set to the intermediate frequency. In a system with n sensor signals $x_i(t)$, i=1, . . . n, we get m signals $\bar{x}_j(t)$, j=1, . . . m, where m≤n. The frequency shift adapts to the instantaneous input signal frequency estimate $\hat{f}_{sig}(t)$. Each signal is preprocessed individually or signals may be processed together 600. Afterwards all the signals are combined as described above with regard to FIG. 6. The band-pass and loop filters are specifically designed for the intermediate frequency of the loop. Subsequently, the phase estimates are corrected by the instantaneous phase shift introduced by the frequency shift towards $f_i$. An advantage of such a frequency shifting is that the loop filters and preprocessing filters do not need to be adapted to $\hat{f}_{sig}(t)$ but may have a fixed design. This allows the application of arbitrarily complex filter design techniques since the filters do not need to be designed in real time down hole but just once during the development phase.

Those versed in the art would recognize that the accelerometers are sensitive not only to rotation of the sensors but also to whirl of the drillstring. Regarding the estimation of the tool phase from the earth gravity field, whirl acts as noise. For this reason, accelerometers may be positioned near the stabilizer 58*a*. This will reduce the effect of the whirl. In addition, the frequency-shifting method with its highly optimized filters described above attenuates not only harmonics but also noise that may be present due to e.g. whirl.

In another embodiment of the disclosure, the rotational sensors may be positioned at one or more locations on the drillstring. Using accelerometers as the sensors, the orientation of the drillstring relative to the gravity field can be estimated. Using magnetometers as sensors, the orientation of the drillstring relative to the earth's magnetic field can be estimated.

In another embodiment of the disclosure, the rotational sensors may be disposed on a stabilizer, such as 58*a*. This is not to be construed as a limitation as there may be more than one stabilizer downhole. As disclosed in U.S. Pat. No. 7,413,032 to Krueger, the stabilizers have multiple ribs that may be independently adjusted to extend out and contact the wall of wellbore 26 and exert a force on wall of wellbore. The ribs may be actuated by a hydraulic system, an electro-hydraulic system wherein a motor drives the hydraulic system and/or an electro-mechanical system wherein a motor drives the ribs using mechanical power transmission elements such as gears (not shown). Any suitable mechanism for operating the ribs may be utilized for the purpose of this invention. The lower stabilizer 58*a* also acts as a bearing housing for the drive shaft of drilling motor such that the adjustable ribs only rotate when drillstring rotates. Measurements made on the stabilizer are likely to have a better signal to noise ratio than measurements made with sensors on other parts of the downhole system.

Figure 8:
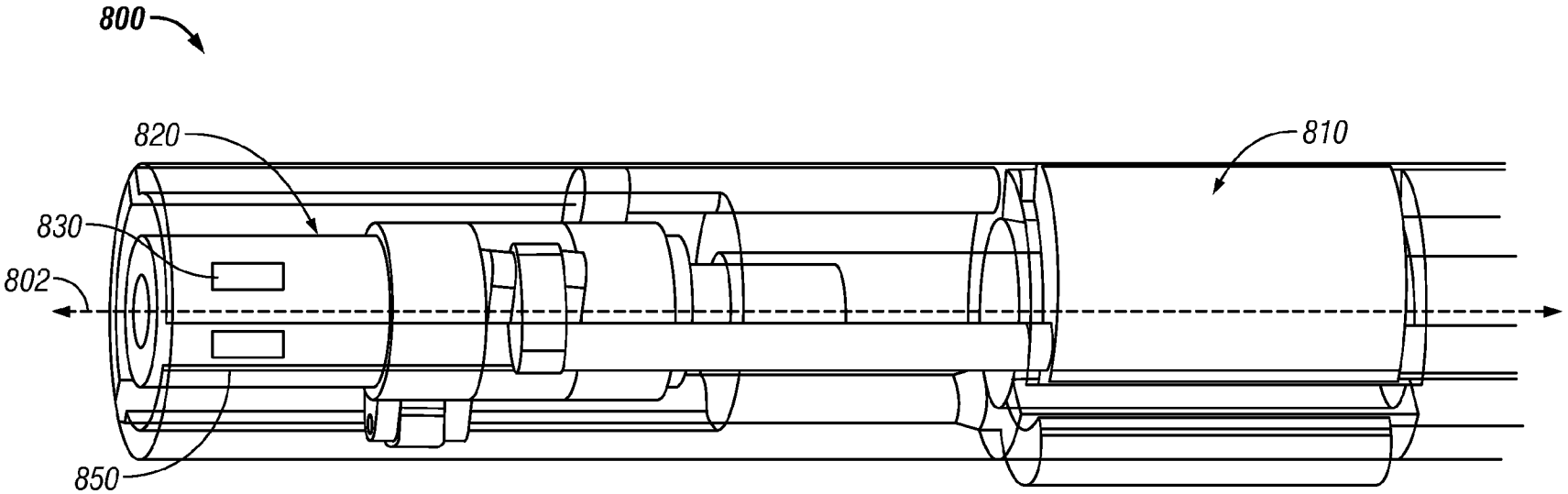
FIG. 8 illustrates elements of a steering device.
Figure 9:
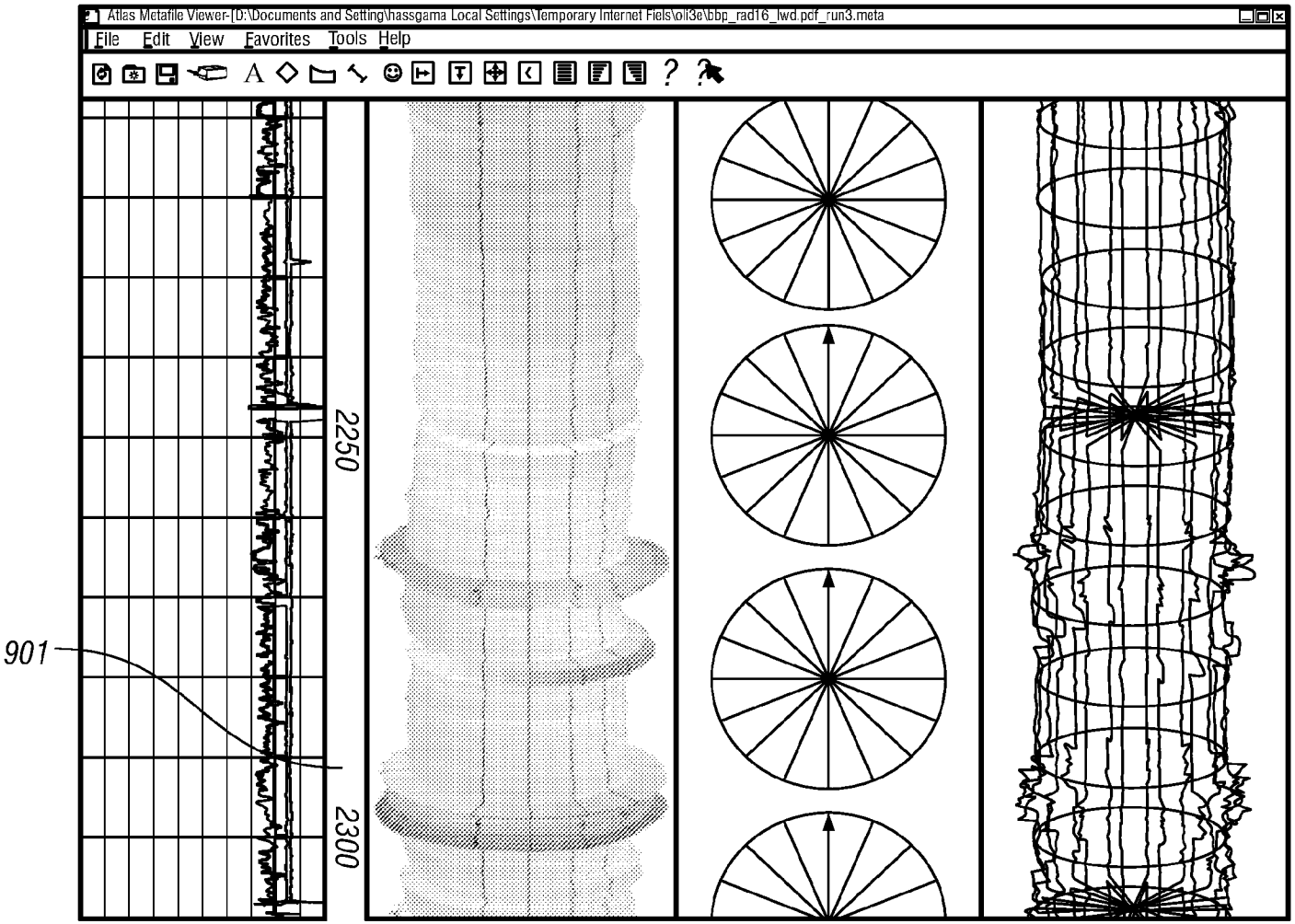
FIG. 9 shows an exemplary display of borehole geometry using acoustic measurements made in a borehole.

In another embodiment of the disclosure, accelerometers and/or magnetometers are mounted on a steering device. Portions of an exemplary steering device 800 are shown in FIG. 8 and represent a modification of a device disclosed in U.S. patent application Ser. No. 12/191,025 of Peters et al., having the same assignee as the present disclosure and the contents of which are incorporated herein by reference. The axis of the device is indicated by 802. In brief, the device includes an actuator 820 and force application members 810 that apply force to the borehole wall responsive to motion of the actuator 820. The actuator is maintained in a substantially stationary relationship relative to the borehole wall by a control unit (not shown). In one embodiment, the control unit rotates the actuator 820 in a direction opposite to the rotation of the BHA 90 and at rotational speed that is the same as the BHA 90 rotation speed.

Sensors (a single sensor is shown) 830 that may be accelerometers provide 3-component measurements of acceleration of the actuator 820. The accelerometer signals are processed using the method described above to provide an estimate of the toolface angle, or of an angle of the actuator 820 relative to the earth's gravity. Alternatively, or additionally, magnetometers may be used to provide measurements that are processed to estimate the toolface angle angle, or an angle of the actuator 820 relative to the earth's magnetic field. These angle estimates are then used to control the direction of drilling by altering the forces applied to the force application members 810.

A particular application of the method described above is in near-horizontal boreholes. The BHA may be provided with formation evaluation (FE) sensors such as gamma ray sensors, resistivity sensors and acoustic sensors. The orientation of the sensors with respect to a gravity reference or a magnetic reference is determined using methods described above. The outputs of the FE sensors are then processed using known methods to provide an image of the formation along the near-horizontal borehole. It is also possible to use the methods described in U.S. Pat. No. 7,548,817 to Hassan et al., having the same assignee as the present disclosure and the contents of which are incorporated herein by reference, to estimate the geometry of the borehole using measurements of an acoustic caliper 77 (FIG. 1). The estimated geometry can serve as a check on the steering methods. FIG. 8, shows a 3-D view of the borehole wall. The vertical axis here is the drilling depth. The right track of the figure shows a series of cross sections of the borehole. The middle track shows the 3-D view and zones of washouts such as 901 are readily identifiable.

When orientation measurements are made of the actuator 820 of the steering device, it is possible to make seismic measurements while drilling without having to stop drilling operations or waiting for a time when ambient noise is low. U.S. Pat. No. 7,299,884 to Mathiszik, having the same assignee as the present disclosure and the contents of which are incorporated herein by reference, addresses some of the problems that arise due to drilling noise while making seismic measurements. With a detector such as 850 on the actuator, it is possible to make seismic measurements while continuing drilling operations and increasing the signal-to-noise ratio (SNR) by stacking measurements made at substantially the same orientation of the sensor. The sensor could be a hydrophone or a multicomponent geophone. Signals produced by the seismic sensor responsive to the activation of a surface seismic source are stacked and processed using known methods to produce a seismic image of the subsurface.

The method discussed above for estimating the orientation of a downhole assembly is also applicable to drilling using a drilling liner. Such a system is disclosed in U.S. Pat. No. 6,196,336 to Fincher et al., having the same assignee as the present disclosure and the contents of which are incorporated herein by reference. As disclosed therein, a drilling liner having a core bit at its bottom end is carried along with a pilot bit on an inner bottom hole assembly driven by a downhole mud motor. Directional drilling is accomplished by having an MWD device for providing directional information and having directional devices on the inner and outer assembly.

Another application for the methods discussed above is in reaming of boreholes. As described in U.S. Pat. No. 7,036,611 to Radford et al., having the same assignee as the present disclosure and the contents of which are incorporated herein by reference, an expandable reamer apparatus includes a laterally movable blade carried by a tubular body, the blade being configured to be selectively positioned at an inward position and an expanded position. This particular device can be operated to ream in a selected direction. The direction of reaming is determined in part by a measurement of the orientation of the reaming apparatus.

For the purposes of the present disclosure, the orientation sensor may be considered to be operatively coupled to the BHA during rotation of the BHA regardless of the disposition of the sensor. The orientation sensor thus provides an orientation signal during rotation of the BHA and the orientation signal is used to determine the orientation of the sensor and the particular location of the downhole system where the sensor is positioned.

The processing of the data may be done by a downhole processor that provides the toolface angle substantially in real-time enabling prompt decisions on controlling the drilling direction. The toolface angle provided by the method described above may also be used in evaluating directionally sensitive measurements made by formation evaluation sensors on the BHA. These include gamma ray, density, resistivity, and acoustic images of the borehole. It should be noted that images may also be obtained of images of the casing in a cased hole. Such angle measurements are also used in imaging of the borehole wall. Implicit in the control and processing of the data is the use of a computer program on a suitable machine readable-medium that enables the processors to perform the control and processing. The machine-readable medium may include ROMs, EPROMs, EEPROMs, flash memories and optical disks. The term processor is intended to include devices such as a field programmable gate array (FPGA).

What is claimed is:

1. A method of conducting drilling operations, the method comprising:

conveying a bottomhole assembly (BHA) into a borehole;

using at least one sensor on the BHA to provide a signal indicative of a direction of a naturally existing field;

using at least one sensor on the BHA to provide a signal indicative of an instantaneous angular velocity of a drilling tubular; and using at least one processor including a phase locked loop for estimating a toolface angle of the at least one naturally existing field direction sensor using (i) the naturally existing field direction signal, (ii) the instantaneous angular velocity signal, and (iii) a phase difference between the naturally existing field direction signal and a reference signal.

2. The method of claim 1 wherein the at least one sensor is selected from the group consisting of: (i) an accelerometer, (ii) a magnetometer, and (iii) a gyroscope.

3. The method of claim 1 further comprising positioning the at least one sensor on at least one of: (i) the BHA, (ii) a stabilizer, (iii) the drilling tubular, (iv) a reamer, (v) a drilling liner, and (vi) a substantially non-rotating component of a steering device.

4. The method of claim 1 further comprising estimating an angle relative to the direction of the naturally existing field, where the naturally existing field includes at least one of: (i) a gravitational field of the earth, and (ii) a magnetic field of the earth.

5. The method of claim 1 further comprising using the toolface angle for controlling a direction of drilling.

6. The method of claim 1 further comprising making a measurement with a formation sensor during the rotation and producing an image of at least one of: (i) the formation, and (ii) a casing.

7. The method of claim 1 further comprising producing an image of the geometry of the borehole using measurements made with an acoustic caliper.

8. The method of claim 1 further comprising generating the reference signal using an oscillator, a loop filter and a phase detector.

9. The method of claim 8 further comprising using an output of a frequency estimator as an input to the oscillator to provide the reference signal.

10. The method of claim 1 wherein the at least one sensor is positioned on a substantially non-rotating component of a steering device, the method further comprising:

(i) positioning a seismic sensor on the substantially non-rotating component, (ii) activating a seismic source at a surface location, and (iii) producing a seismic image of the subsurface using a signal produced by the seismic sensor responsive to activation of the seismic source.

11. An apparatus for conducting drilling operations, the apparatus comprising:

a bottomhole assembly (BHA) configured to be conveyed into a borehole;

at least one sensor operatively coupled to the BHA and configured to provide a signal indicative of a direction of a naturally existing field;

at least one sensor operatively coupled to the BHA and configured to provide a signal indicative of an instantaneous angular velocity of the BHA; and at least one processor including a phase locked loop and configured to estimate a toolface angle of the at least one naturally existing field direction sensor using (i) the naturally exiting field direction signal, (ii) the instantaneous angular velocity signal, and (iii) a phase difference between the naturally existing field direction signal and a reference signal.

12. The apparatus of claim 11 wherein the at least one sensor is selected from the group consisting of: (i) an accelerometer, (ii) a magnetometer, and (iii) a gyroscope.

13. The apparatus of claim 11 wherein the at least one sensor is positioned on at least one of: (i) the BHA, (ii) a stabilizer, (iii) the drilling tubular, (iv) a reamer, (v) a drilling liner, and (vi) a substantially non-rotating component of a steering device.

14. The apparatus of claim 11 wherein the toolface angle that the at least one processor is configured to estimate further comprises an angle relative to the direction of the naturally existing field, where the naturally existing field includes at least one of: (i) a gravitational field of the earth, and (ii) a magnetic field of the earth.

15. The apparatus of claim 11 wherein the at least one processor is further configured to use the toolface angle for controlling a direction of drilling.

16. The apparatus of claim 11 further comprising a formation evaluation sensor configured to make a measurement of a property of the earth formation during the rotation and wherein the at least one processor is further configured to produce an image of the earth formation.

17. The apparatus of claim 11 further comprising an acoustic caliper and wherein the at least one processor is configured to produce an image of the geometry of the borehole using measurements made with the acoustic caliper.

18. The apparatus of claim 11 wherein the at least one processor is further configured to estimate the toolface angle by using an oscillator, a loop filter and a phase detector.

19. The apparatus of claim 18 wherein the at least one processor is further configured to use an output of a frequency estimator configured to provide the reference signal.

20. The apparatus of claim 11 wherein the at least one sensor is positioned on a substantially non-rotating component of a steering device, the apparatus further comprising:

(i) a seismic sensor on the substantially non-rotating component configured to produce a signal responsive to activation of a seismic sensor at a surface location, and wherein the at least one processor is further configured to produce a seismic image of the subsurface using the signal produced by the seismic sensor.

* * * * *